United States Patent [19]

Sanfilippo et al.

[11] Patent Number: 5,001,878

[45] **Date of Patent: * Mar. 26, 1991**

[54] APPARATUS FOR PROVIDING CONTAINERS WITH A CONTROLLED ENVIRONMENT

[76] Inventors: John E. Sanfilippo; James J. Sanfilippo, both of Box 367, Barrington Hills, Ill. 60010

[ * ] Notice: The portion of the term of this patent subsequent to Apr. 21, 2004 has been disclaimed.

[21] Appl. No.: 184,282

[22] Filed: Apr. 21, 1988

Related U.S. Application Data

[63] Continuation-in-part of Ser. No. 40,285, Apr. 20, 1987, abandoned, which is a continuation of Ser. No. 818,386, Jan. 13, 1986, Pat. No. 4,658,566, which is a continuation of Ser. No. 705,661, Feb. 26, 1985, abandoned.

[51] Int. Cl.[5] ..... B65B 31/02; B65B 31/06

[52] U.S. Cl. ..... 53/510; 53/88; 53/91; 53/95; 141/63; 141/64

[58] Field of Search ..... 53/88, 433, 91, 510, 53/512, 95, 96, 403, 408, 101, 102, 103, 106, 107; 141/63, 64, 4, 7, 48, 59

[56] References Cited

U.S. PATENT DOCUMENTS

| | | | |
|---|---|---|---|
| 2,240,655 | 5/1941 | Kronquest . | |
| 2,295,692 | 9/1942 | Sanfranski et al. | 53/101 |
| 2,380,903 | 7/1945 | Ray | 53/405 |
| 2,412,167 | 12/1946 | Minaker . | |
| 2,718,345 | 9/1955 | Howard | 141/48 X |
| 2,768,487 | 10/1956 | Day et al. . | |
| 2,795,090 | 6/1957 | Sterna | 198/481 |
| 2,855,006 | 10/1958 | Geisler | 141/7 |
| 3,135,303 | 6/1964 | Gordon et al. | 53/95 |
| 3,250,213 | 5/1966 | Briglam et al. | 198/481 |
| 3,289,383 | 12/1966 | Foss . | |
| 3,321,887 | 5/1967 | Manas | 141/64 X |
| 3,332,201 | 7/1967 | Cooper | 53/510 X |
| 3,363,741 | 1/1968 | Dierksheide | 198/481 |
| 3,398,500 | 8/1968 | Inman | 53/510 X |
| 3,452,513 | 7/1969 | Owens, Jr. | 53/510 X |
| 3,478,785 | 11/1969 | Mallrich et al. | 141/48 X |
| 3,508,373 | 4/1970 | Robinson, Jr. . | |
| 3,619,975 | 11/1971 | Johnson et al. . | |
| 3,670,786 | 6/1972 | Levin et al. . | |
| 3,899,862 | 8/1975 | Muys et al. . | |
| 3,939,287 | 2/1976 | Orwig et al. . | |
| 3,946,534 | 3/1976 | Egly . | |
| 4,014,158 | 3/1977 | Rausing . | |
| 4,027,450 | 6/1977 | Chiu et al. . | |
| 4,055,931 | 11/1977 | Myers . | |
| 4,140,159 | 2/1979 | Domke . | |
| 4,294,859 | 10/1981 | Lundquist et al. . | |
| 4,409,252 | 10/1983 | Buschkens et al. . | |
| 4,658,566 | 4/1987 | Sanfilippo | 53/510 X |
| 4,791,775 | 12/1988 | Raque et al. | 53/510 |

FOREIGN PATENT DOCUMENTS

| | | | |
|---|---|---|---|
| 463300 | 2/1950 | Canada | 141/64 |

*Primary Examiner*—Horace M. Culver
*Attorney, Agent, or Firm*—Willian Brinks Olds Hofer Gilson & Lione

[57] ABSTRACT

An apparatus for providing a container with a controlled environment utilizes a first flow system for applying a first source of environment to the interior of the container, a second flow system for applying a second source of environment to the interior of the container, and means for controlling application of the individual sources of environment such that the first and second sources of environment are applied simultaneously for at least some period of time. The apparatus is useful, for example, in food packaging applications whereby oxygen is removed from the food containers and replaced with a substantially inert environment prior to sealing the containers. In a preferred embodiment, a rotary drum-type apparatus is employed for exposing containers in a continuous sequence to the individual sources of controlled environment.

19 Claims, 5 Drawing Sheets

APPARATUS FOR PROVIDING CONTAINERS WITH A CONTROLLED ENVIRONMENT

This application is a continuation-in-part of application Ser. No. 07/040,285, now abandoned, filed on Apr. 20, 1987, which in turn is a continuation of application Ser. No. 06/818,386, filed on Jan. 13, 1986, now U.S. Pat. No. 4,658,566. Application Ser. No. 06/818,386 is a continuation-in-part of application Ser. No. 06/705,661, filed on Feb. 26, 1985, now abandoned.

TECHNICAL FIELD

This invention relates to an apparatus for exposing a container to a controlled environment, such as to accomplish removal of one environment from a container or sequence of containers and replacement with a new environment. More particularly, the invention is directed toward nearly complete removal of atmospheric oxygen from containers for storing oxygen-sensitive food products using a combination of vacuum and an inert environment.

BACKGROUND OF THE INVENTION

In certain industries it is necessary to remove as much of an original environment from contact with a product as possible and to replace it with a new environment. Fat and oil containing foods, for example, are very susceptible to attack from oxygen and can be preserved much longer in its absence. A near complete removal of oxygen from containers for storing oxygen-sensitive products has, until now, required complex and/or expensive equipment and often has required specialized and/or expensive containers.

Oxygen removal has traditionally been accomplished by packaging under vacuum. Vacuum pressure can be described in terms of inches of mercury, with zero inches being normal atmospheric pressure and approximately 30 inches being a perfect vacuum. The percentage of original oxygen remaining after applying a vacuum to a container is inversely proportional to the level of vacuum applied, for a single stage vacuum system. For example, a container originally exposed to a normal atmosphere would retain only about 17% of its original oxygen content after application of a 25 inch vacuum. This is calculated according to the equation:

$$\text{\% of original oxygen remaining}$$

$$= 100\% \times \left(1 - \frac{\text{Vacuum drawn}}{\text{Perfect Vacuum}}\right)$$

$$= 100\% \times \left(1 - \frac{25 \text{ inches}}{30 \text{ inches}}\right) = 17\%$$

In other words, about 83% of the original oxygen would be removed using a single stage vacuum packaging operation which applies 25 inches of vacuum.

If one were to repeat the above operation by refilling the container with an inert gas and then applying a second stage of 25-inch vacuum, the percentage of original oxygen theoretically remaining in the container would be:

$$= 17\% \times \left(1 - \frac{25 \text{ inches}}{30 \text{ inches}}\right) = 2.8\%$$

In actual practice, however, it has been found that the oxygen content is not significantly further reduced, even when the operation is repeated as many as four or five times. The suspected reason for this is that when vacuum is drawn on a container with a single open end and the container is then filled with inert gas from the same open end, the oxygen remaining as part of the original atmosphere will initially concentrate at the bottom of the container while the inert gas will fill the top. If vacuum is again applied before the remaining oxygen has mixed with the inert gas, the gas removed by the vacuum will consist primarily of the inert gas just added and will contain very little of the remaining oxygen.

Therefore, in order to achieve a near complete removal of oxygen using prior art systems it has been necessary to draw a very high degree of vacuum in the container. This requires very expensive and complex equipment. Furthermore, in order to package products under vacuum, it is necessary to utilize relatively sturdy (and expensive) container materials which are capable of withstanding such vacuum for extended periods of time.

One technique for supplying a controlled environment utilizes individual "bell jar" enclosures which surround the container. Such a device is disclosed, for example, by U.S. Pat. No. 2,292,887 issued to McBean. Although such devices may be adapted for continuous operation, the apparatus necessary for moving the container and/or the "bell jar" relative to one another adds considerable complexity and cost to the device. Robinson U.S. Pat. No. 3,508,373 discloses a reservoir to which vacuum and gas are alternately applied to remove the oxygen from a package positioned therein.

Other devices are known which cooperate directly with the opening of the container to apply, for example, a vacuum or an inert gas substantially to the interior of the container only. U.S. Pat. No. 2,457,690 issued to Kronquest discloses an example of such a vacuum-head apparatus. Such devices, however, are complex, and are not readily adaptable to use with containers having differing configurations and sizes. Furthermore, if the product is packaged under vacuum, the container must be sufficiently durable to withstand the pressure of the atmosphere both before and after sealing.

It is further known to utilize a multichambered rotary drum, in which individual chambers may accept a container to be subjected to the controlled environment. As the drum rotates, the chambers transporting the containers move past and engage an outer enclosure which seals the opening of the chamber, and a vacuum or other environment is applied. U.S. Pat. Nos. 1,751,643 issued to Malmquist, 2,521,746 issued to Preis, and 1,774,529 issued to Sharp illustrate various configurations of such known devices.

A particularly advantageous rotary drum device overcoming many of the foregoing problems associated with the prior art devices by replacing a rigid outer enclosure with a substantially continuous flexible belt enclosure. Such a device is disclosed in application U.S. Ser. No. 818,386, now U.S. Pat. No. 4,658,566, the entire disclosure of which is incorporated herein by reference.

In order to overcome the shortcomings of the prior art, it is an object of the current invention to obtain nearly complete exchange of environments in containers. Another object is to provide the containers with such a controlled environment without necessarily utilizing very high vacuum.

A further object of the invention is to provide an apparatus which imparts a controlled environment to one or more containers at or near atmospheric pressure prior to sealing, allowing the use of less expensive container materials than used for the vacuum-packaging devices of the prior art. A related object is to provide an apparatus which achieves the desired near-total atmospheric exchange or control without at any time subjecting the container walls to significant pressure differentials.

One specific object is to provide a rotating drum apparatus which accomplishes near complete removal of a first environment (such as oxygen-containing air) from a sequence of containers and which replaces such first environment with a second environment (such as a substantially inert gas).

A further object is to provide a rotary drum device for providing a controlled environment to one or more containers which provides a secure closure of desired individual chambers during rotation of the drum without significantly interfering with such rotation. A related object is to provide such an apparatus which does not introduce significant friction between the sealing enclosure and the rotating drum.

An important object of the present invention is to provide such an apparatus for use in a continuous processing operation, which is mechanically simple, having few components and which is therefore economical and highly reliable.

Another object is to provide such an apparatus which is readily adaptable for use with varying sizes and configurations of jars and other containers, including containers of different heights. A further related object is to provide such a system adapted for receiving containers of differing diameters.

These and other objects shall be apparent in light of the present specification.

SUMMARY OF THE INVENTION

In order to achieve a near complete substitution of an oxygen-containing or other environment within containers, means are provided for exposing the container to two or more individual sources of environment, including means for applying the environments simultaneously for at least some period of time. A first source of environment is applied through a first flow means. A second source of environment is applied through a second flow means. For each individual source of environment, means are provided for selectively connecting each source of environment to the interior of the container. Control means are provided for selectively applying or isolating each source of environment from the interior of the container, such that first and second sources of environment are applied simultaneously for at least some period of time.

The connecting means may include one or more plenums communicating directly with the interior of the container for supplying each individual source of environment thereto. Alternatively, the container may be positioned within a sealed chamber such that at least one of the individual sources of environment (for instance, a vacuum source) communicates with the interior of the chamber. In the latter embodiment, communication means such as conduits must be provided between the interior of the sealed chamber and the interior of the container in order to allow application of the one source of environment from the chamber to the container.

The control means may comprise electrically or mechanically operated valves, pneumatic valves, or any other means which is suited to the particular application and the specific environments to be supplied. The control means should be capable of operating in such fashion that at least two individual sources of environment can be applied alone or in combination with each other. In the presently preferred embodiment, a multi-stage plenum is provided which supplies the desired environments to the chambers as the chambers pass beneath openings in the plenum. The relative sizes and locations of the openings control sequencing and timing of application of the environments.

By providing at least two flow systems for delivering environments to the container, the environments may be applied simultaneously. Thus, for example, in an oxygen removal process utilizing an inert gas and vacuum, the control means must provide for the environments to be applied simultaneously to the container for at least some period of time in order to achieve the desired advantageous operation.

In a highly preferred embodiment, the simultaneous application of environments is controlled such as to create a net circulation within the containers. This is accomplished by forming a seal on the top of each container and, while the container is under vacuum, entering an environment such as inert gas on one side of the container while removing an environment on the other side using, for instance, a vacuum drawing source. The inert gas preferably passes through the product and down to the bottom of the container along one side, and then up and out through the other side. This circulation eventually forces substantially all of the original environment (e.g. the oxygen-containing environment) out of the container, replacing it with an environment substantially consisting of inert gas. The result is to substantially reduce the amount of oxygen in the container without requiring numerous processing steps or very high vacuum. This embodiment of the invention provides a very efficient and effective system for removing almost all of the atmosphere from the product container prior to sealing, an accomplishment which previously required almost total vacuum.

In a preferred embodiment, the inert environment continues to be fed to the container after the vacuum has been deactivated, filling the container with the inert environment until the pressure inside the container reaches atmospheric pressure.

While the invention has useful application in situations requiring substantial removal of oxygen and replacement with an inert environment, the invention is not limited to such situations but is also useful in other situations requiring application of a controlled environment to a container or other object. Possible sources of environment include both inert and non-inert gases, vacuum, and mixtures thereof, and in certain embodiments may include fluids, aerosols, suspended particulates and other distributed solids, jelly, syrups, oil, and mixtures of these and other environments.

An important feature of the invention is that the controlled environment provided to the container or object may be supplied from any number of individual sources depending on the requirement of each individual application. In packaging applications involving the removal of oxygen, for instance, the environment may preferably be supplied from at least two independent sources, one inert gas source and one vacuum source. In a highly preferred embodiment, both inert gas and vacuum will be supplied at a plurality of positions in the top of the container in order to maximize circulation of gases and alleviate product damage within the container.

For most applications, the flow rates of inert gas and vacuum are preferably of such magnitude as to cause a net vacuum pressure within the container of greater than about 25 inches of mercury. Lower vacuum may be sufficient for some applications. If the vacuum is too low or if the inert gas flow rate is too low, a less than required amount of inert gas will pass through the bottom of the container. Some of the inert gas may be "short-circuited" (i.e. will exit the container without significantly mixing with the oxygen in the container). An optional way to prevent short circuiting is to place one or more baffles in the container during the oxygen removal process, positioned in such fashion as to force the inert gas to the bottom of the container before exiting into the vacuum system.

When the controlled environment comprises a source of vacuum and a source of gas, a preferred embodiment utilizes a plunger or other contacting means which is positioned in a contacting position with the top (open portion) of the container. The container and contacting means are located inside a sealed chamber. The gas source is applied directly to the interior of the container through one or more inlet ports located in and passing through the contacting means. The vacuum is applied initially to the interior of the chamber and is transmitted to the interior of the container through channels or conduits in the contacting means which communicate from the interior of the chamber to the interior of the container. Preferably, a plurality of communication channels are provided in the contacting means for applying each source of environment in order to maximize circulation of gases within the container.

In other embodiments of the invention, the apparatus of application Ser. No. 06/818,386 are combined with the above preferred embodiments to allow nearly complete removal of one environment and replacement with a new environment in a sequence of containers in a continuous fashion. The apparatus of one embodiment of the invention utilizes a flexible member, such as a plastic or rubber belt, as the outer enclosure for a multi-chambered rotary drum. The flexibility of the outer enclosure permits it to conform to the periphery of the rotary drum, including minor imperfections or specialized non-circular configurations.

Further, the flexible belt may be provided as a continuous loop which contacts the outer periphery of the rotary drum for a portion of its rotational distance, thereafter looping back in a continuous fashion over suitable pulleys or other guide means. By permitting or requiring the flexible belt to move in substantially synchrony with the rotary drum, relative movement between the flexible belt outer enclosure and the peripheral surface of the rotary drum may be reduced or eliminated. In this way, problems of providing a sliding seal between the prior art fixed enclosures and the rotary drum are overcome, and problems of wear and mechanical complexity of such sliding seals are eliminated. Movement of the rubber belt in conjunction with the rotary drum may be accomplished either by permitting a passive rubber belt to track and follow the rotary drum by means of friction, or by providing suitable drive means to drive the belt loop as desired.

In one embodiment of the invention, the lidding and sealing of the containers takes place at a location separate from the multi-chambered rotary drum. With this embodiment, it is desirable to provide a means for maintaining the controlled environment within the container after it leaves the rotary drum and before it enters the lidding and sealing apparatus. If the controlled environment comprises an inert environment such as nitrogen, for instance, it would be desirable to provide a nitrogen blanketing means in the exit channel which imparts nitrogen to the openings of the respective containers at a small positive pressure in order to prevent oxygen from entering the containers. Furthermore, it would be desirable to provide means for supplying nitrogen to the container within the rotary drum until the container enters the exit channel.

Alternatively, the multi-chambered rotary drum may include a lidding and sealing mechanism within the rotary drum. In this embodiment, means must be provided for maintaining the controlled environment inside the containers within the rotary drum until lidding and sealing takes place.

The foregoing and other embodiments of the invention will be further described in the following detailed description made with reference to the accompanying figures.

DETAILED DESCRIPTION OF THE PREFERRED EMBODIMENTS

Figure 1:
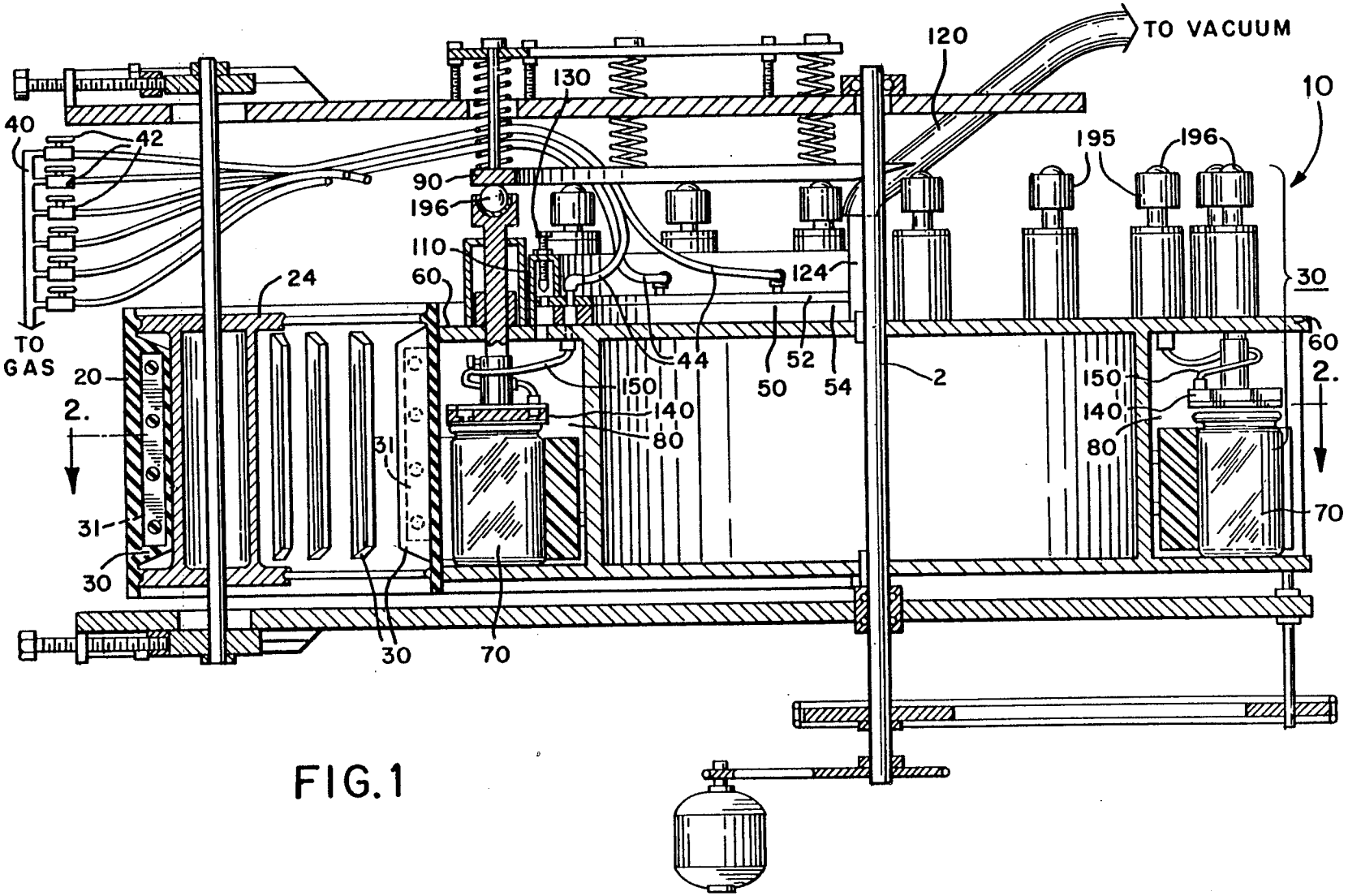
FIG. 1 is a side sectional view of a rotary drum-type embodiment of the invention for providing containers with a controlled environment.

The remaining portion of the specification will describe preferred embodiments of the invention in conjunction with the attached drawings, in which like reference characters refer to identical apparatus.

FIG. 1 shows a side view of a presently preferred embodiment. Means for connecting the device to two sources of environment are provided. Specifically, a hose 120 is provided for connection to a source of vacuum. Other conduits, of course, may similarly be employed, or a vacuum pump may be incorporated into the device itself. Means such as hoses 44 connecting to a main supply line 40 (FIG. 2) are similarly provided for connecting the device to a source of gas, which in the preferred embodiment comprises nitrogen or some other inert gas. Suitable known connectors may be used for attaching the hoses 120 and 44 to the sources of gas and vacuum, respectively. If additional sources of environment are utilized, additional connecting means will be similarly provided.

Means are also illustrated for selectively connecting the sources of environment to the interior of the containers 70. For example, with respect to the vacuum environment, hose 120 is connected to a distribution manifold 110 which supplies the vacuum to each of the several individual processing stages. The vacuum is in turn applied to a sliding seal 50 which, as discussed more fully herein, includes individual slotted openings through which flow from the manifold 110 is controlled by means of valves 130. The slotted openings in the sliding seal 50 align periodically with a first opening through the top of the rotary drum chamber 80 as the opening passes below the sliding seal during rotation of the drum. When the sliding seal slotted opening and the opening in the top of the drum are aligned, the vacuum is conducted to the interior of the sealed chamber 80. Finally, a conduit in the contacting plunger 140 communicates at a first end with the interior of the chamber (and therefore with the applied vacuum) and at a second end with the interior of the container 70 through a plurality of ports as discussed more fully herein. Thus, the interior of the container 70 is connected selectively to the source of vacuum.

Figure 2:
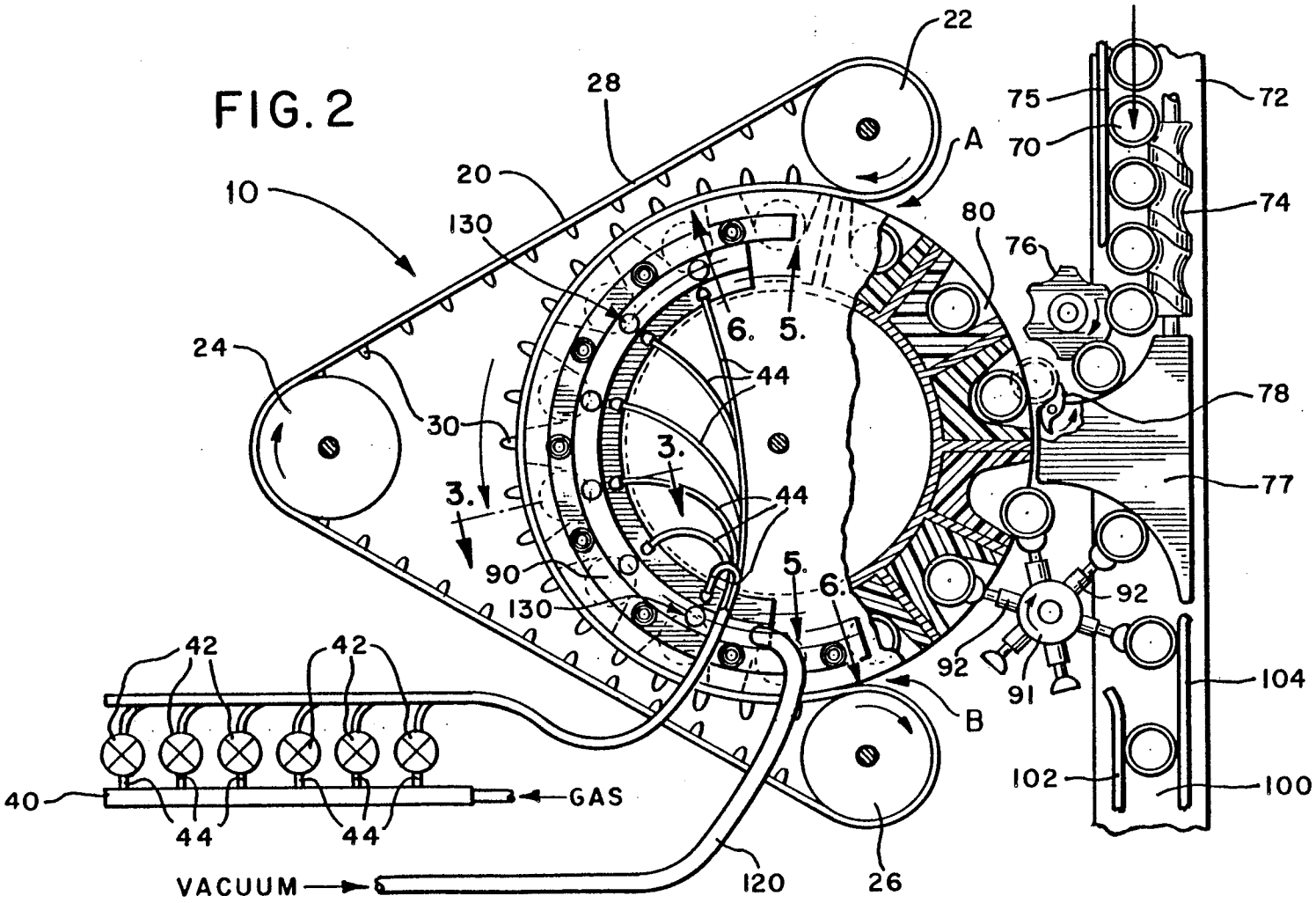
FIG. 2 is a partially cut away top sectional view of the apparatus of FIG. 1 taken along line 2—2.

Similarly, the source of gas is connected selectively to the interior of the container. While the gas could be distributed to the individual stages by means of a manifold similar to vacuum manifold 110, the preferred embodiment utilizes instead individual connecting passages 44 and optional valves 42 in a single manifold 40 (FIG. 2). The gas is then provided to a second set of slotted openings in the sliding seal 50, which cooperate periodically with a second opening in the top of the rotary drum corresponding with an individual chamber as described more fully herein. To maintain separation of the gas and the vacuum present in the interior of the chamber as previously discussed, a flexible tube 150 connects the second opening in each chamber to the plunger 140. Finally, the plunger 140 includes a second set of orifices connected to the flexible tube 150 for supplying the source of gas to the interior of the container, as described more fully herein.

Means are also illustrated for controlling the selective application of the first and second environment, including means for supplying the environments simultaneously at least for some period of time. As shown and discussed more fully in connection with FIG. 4, the sliding seal 50 includes slots 56, 58 which align with and cooperate with the multiple openings 66, 68 into the individual chambers 80 in a selected fashion. Additional optional control is provided by valves 42 (FIG. 5) and needle valves 130 (FIG. 6). The sliding seal 50 in the preferred embodiment illustrated is configured so that both the vacuum and gas are conducted through the respective openings in the rotary drum 10 and thereafter to the interior of the container as discussed above, simultaneously for at least some period of time.

Referring now to FIG. 2, the rotary drum apparatus generally designated as 10 has a plurality of individual chambers 80 opening into its outer periphery. A substantially continuous flexible belt 20 is shown in a loop configuration passing around support pulleys 22, 24, and 26. The flexible belt 20 is brought into contact with a portion of the periphery of rotary drum 10, covering the peripheral openings of the contacted chambers 80 and thereby providing an outer enclosure for the sealed chambers. By "substantially continuously flexible" is meant a belt which is flexible in increments which are at least less than the width of the peripheral openings in the contacted chambers 80. For simplicity, this is sometimes referred to herein as a "flexible belt 20".

In a preferred embodiment, the flexible belt 20 covers more than half of the periphery of the rotary drum 80 in order to maximize the number of chambers to which a controlled environment may be applied at a given instant. The flexible belt 20 may preferably comprise one or more outside layers of a rubber material such as Linatex, manufactured by the Linatex Corporation, Stafford Springs, Conn., in order to provide an airtight seal with the chambers 80. A plurality of cleats 30, preferably comprising polyurethane and having internal steel supports 31 as shown in FIG. 1, are provided at the interior of the flexible belt 20 to impart a degree of stiffness to the flexible belt 20.

In the presently preferred embodiment, the flexible belt 20 comprises an outside layer of Linatex having a thickness of between about 0.125 inches and about 0.188 inches and an adjacent layer of Automate II, a PVK 225 polyvinyl chloride manufactured by, for example, Goodyear Tire and Rubber Co. The layer of Automate II has a thickness of about 0.25 inches. The polyurethane cleats 30 each have a thickness of between about 0.312 inches and about 0.750 inches and project inward from the belt at a distance of about 1.75 inches. For a 15-inch high belt, the cleats would have a length of about 14 inches, allowing about one-half inch of smooth rib-free interior surface at the top and bottom of flexible belt 20. The internal steel supports 31 are preferably about one inch wide, one-eighth inch thick, and almost as high as the cleats 30, and have holes drilled through the steel which interlock with the molding of the polyurethane cleats 30. The polyurethane cleats 30 are preferably placed about two inches apart from each other.

In a typical operation, such as application of a controlled environment to cans or jars of food products, filled containers 70 are provided by suitable means, such as conveyor belt 72, to an insertion means comprising a star wheel 76 for controlled insertion into empty chambers 80 of the rotary drum 10. In the preferred embodiment shown, the containers 70 are sequentially presented, by means of an accelerating feed screw 74 and a guide 75, to a star wheel 76 which forms a channel with a curved guide 77 to guide the containers 70 into the empty chambers 80. Once the containers 70 enter the chambers 80, they are pushed snugly into place inside the chambers 80 by a positioning means 78 to assure proper alignment with the plunger 140 described below.

The inserted containers 70 are then transported within individual chambers 80 of rotary drum 10 to a position identified generally by reference letter A in FIG. 2, where flexible belt 20 contacts the periphery of the rotary drum 10. Because of the locations of support pulleys 22, 24, and 26 relative to the rotary drum 10, the flexible belt 20 is maintained in contact with the periphery of rotary drum 10 for an arc defined generally between reference letters A and B in FIG. 2. During this period of rotation, the flexible belt 20 provides an outer enclosure for chambers 80, substantially sealing them from the outer atmosphere. The sealed chambers may then be used to apply a controlled environment to the interiors of the containers positioned therein. Such an operation is more fully described herein.

Once the desired environment has been established in the containers 70, known means (not shown) may be provided for sealing and securing a lid to each container 70 before the ambient atmosphere is reintroduced to the chamber 80. Alternatively, means (not shown) may be provided remote from the rotary drum 10 for lidding and sealing the containers. In such instances, means will preferably be provided for maintaining the desired inert environment inside containers 70 after the chambers 80 pass through the sealed region effected by the flexible belt 20 and until the containers 70 are removed from the chambers 80 and are transported to the lidding and sealing mechanism. In the embodiment shown in FIG. 2, the open containers are transported by the rotary drum 10 to a position for removal. Removal means 91 is illustrated, comprising a star wheel having biased suction cups 92 for grasping each container 70 and transporting it to the conveyor 100 for transportation to the lidding mechanism (not shown) along a path established by the guides 77, 102, and 104. Means such as a blanketing mechanism may be provided for maintaining the controlled environment which is established between points A and B until the containers 70 are removed from the rotary drum 10 and during their transportation to the lidding and sealing mechanism by the conveyor 100.

As previously indicated, a wide variety of individual sources of environment may be provided to the containers between points A and B including both inert and non-inert gases, vacuum, fluids, aerosols, suspended particulates and other distributed solids, jelly, syrups, oil, and mixtures of the foregoing. In the embodiment illustrated in the accompanying figures, sources of both vacuum and inert gas are provided in order to accomplish a substantially complete removal of oxygen from the containers 70 and replacement with a substantially inert environment prior to lidding and sealing of the containers 70.

Referring again to FIG. 1, a sliding seal 50 slidably engages the top wall 60 in each of said chambers 80 during rotation of the rotary drum 10 within the region defined between points A and B in FIG. 2. The sliding seal 50 includes an upper layer 52, preferably constructed of metal and having a thickness of about 0.625 inches and a lower layer 54, preferably constructed of plastic such as ultra high molecular weight polyethylene and having a thickness of between about one inch and about 1.25 inches.

Figure 4:
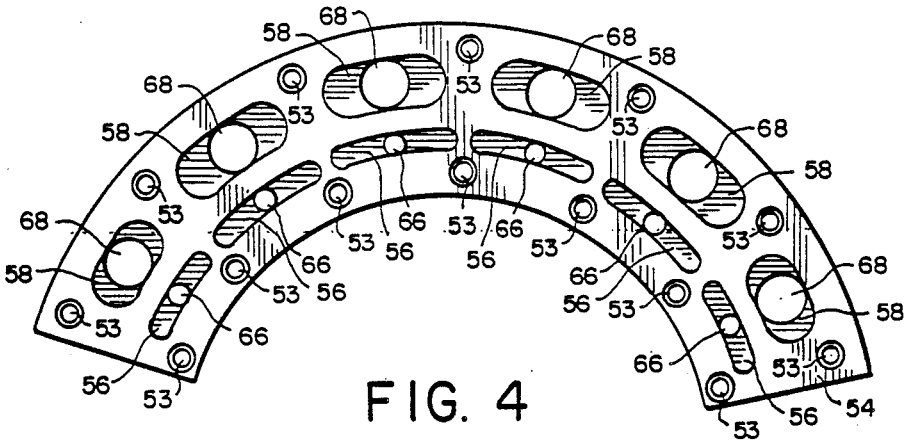
FIG. 4 is a bottom view of a means for applying vacuum and another source of environment to the individual chambers, which may be used in conjunction with the apparatus of FIG. 1.

The lower layer 54 of the sliding seal 50 is configured to supply two individual sources of environment to the chambers 80 in a controlled fashion in a manner illustrated in FIG. 4. As the rotary drum 10 rotates, a first opening 66 in each top wall 60 of each chamber 80 passes beneath and communicates with a first set of slotted openings 56 in the lower layer 54 of the sliding seal 50 through which a first source of environment, such as nitrogen, is supplied to the chamber 80. The period of time during which nitrogen is supplied to each chamber in a given stage is determined by the rotational velocity of the rotary drum 10, the length of the slotted openings 56 and by other means as will be hereinafter discussed.

A second opening 68 in each top wall 60 of each chamber passes beneath and communicates with a second set of slotted openings 58 in the lower layer 54 of the sliding seal 50 through which a second source of environment, such as vacuum, is applied to the chamber 80. The upper layer 52 and lower layer 54 of the sliding seal 50 are connected together and mounted in a stationary fashion using bolts passing through openings 53 as shown. In the embodiment shown, the length of the slotted openings 58 relative to the length of the slotted openings 56 is such that the openings 66, 68 and respective slotted openings 56, 58 will align so as to engage and disengage the first and second sources of environment at approximately the same time as the rotary drum 10 turns.

The velocity and rates at which the first and second environments are applied to the chambers 80 can be varied, to an extent, by varying the size of openings 66 and 68 in the upper wall 60 of each chamber 80. In a preferred embodiment, these flow rates are primarily varied by adjusting valves 42 and/or needle valves 130 as hereinafter described. The duration of application of each source of environment can also be varied to an extent for each individual stage by varying the lengths of the slotted openings 56 and 58 in the lower layer 54 of the sliding seal 50, and by varying the rotational velocity of the rotary drum 10. The number of stages can also be varied.

In the embodiment shown in FIG. 4, six individual stages of environment are illustrated meaning that, as each chamber 80 passes beneath the sliding seal 50, each source of environment may if desired be applied to the chamber and disengaged up to six times (i.e. in six different stages). The number and length of the individual processing stages within the sealed portion of the rotary drum 10 will necessarily be limited by the length of the outer periphery of the rotary drum 10 which is sealed by the flexible belt 20 as shown in FIG. 2. As the rotary drum 10 turns, each chamber 80 passes through the six stages whereby environment may be applied in a controlled fashion in each stage.

Figure 5:
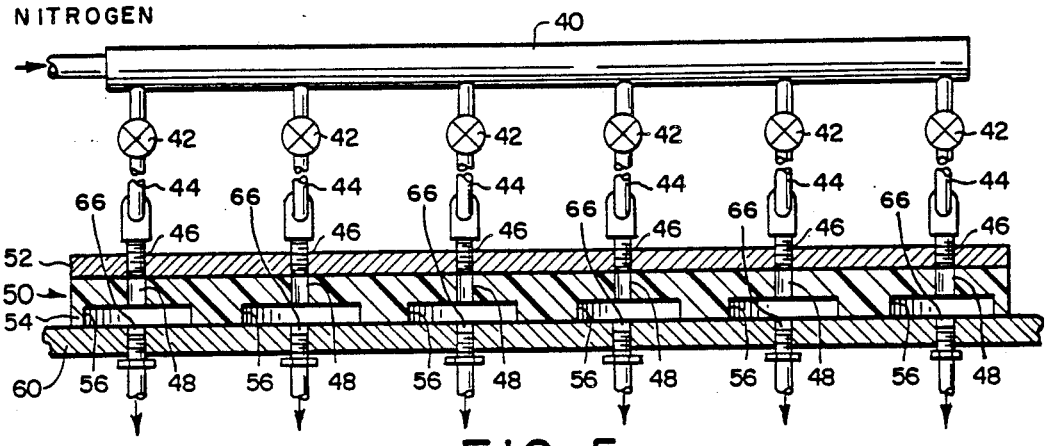
FIG. 5 is a sectional view of one embodiment of the means for supplying a first source of environment to the chamber, taken along line 5—5 in FIG. 2.
Figure 6:
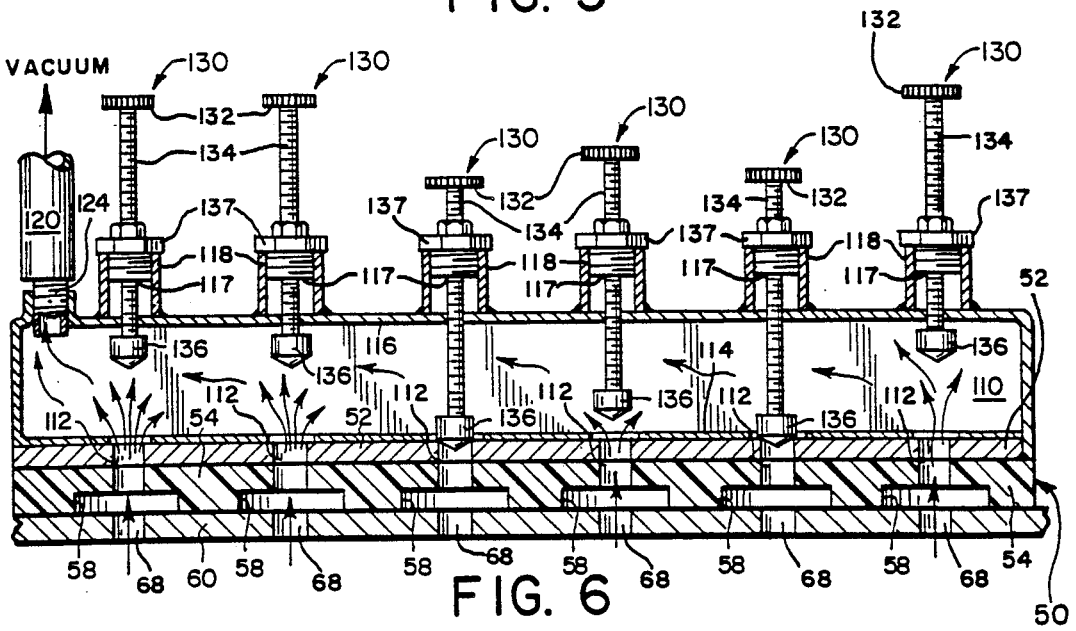
FIG. 6 is a sectional view of a manifold for applying a second source of environment such as vacuum to the chambers, taken along line 6—6 in FIG. 2.
Figure 7:
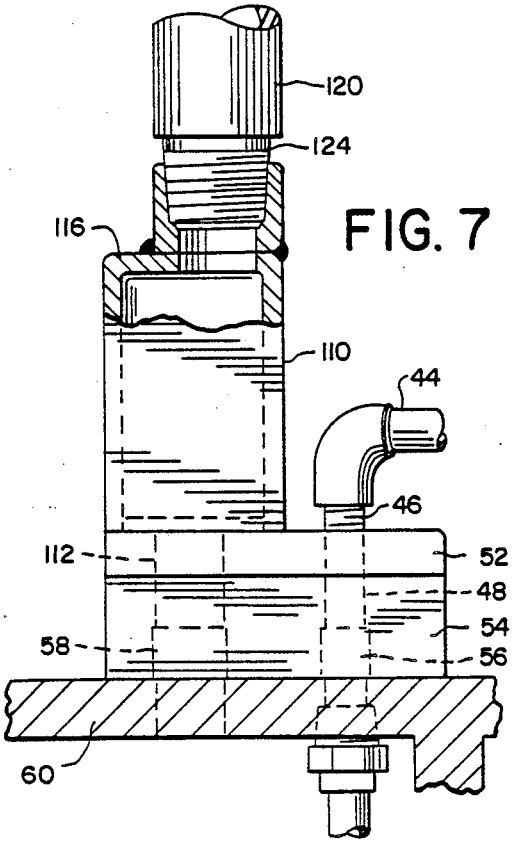
FIG. 7 is an end view of the manifold of FIG. 6.

Referring to FIG. 5, a main supply line 40 leading from a first source of environment comprising a nitrogen source feeds into six individual supply lines 44 leading to the six individual stages defined by the sliding seal 50. Each individual supply line 44 is connected, by means of a threaded connection 46, to a passage 48. Each passage 48 extends through the upper metal layer 52 and into the lower plastic layer 54 of the sliding seal 50 where it connects to the slotted opening 56. The flow of nitrogen through each supply line 44 can be regulated individually by means of a mechanical valve 42 which can be set in a fully open, fully shut, or partially open position. The regulation of nitrogen flow is not limited to the mechanical valves 42 shown but can be accomplished by any suitable electrical, mechanical, or pneumatic means.

Referring to FIG. 6, a main supply line 120 leading to a second source of environment comprising a vacuum source engages to a threaded pipe 124 extending from a manifold 110. The manifold 110 is positioned above the upper metal layer 52 of sliding seal 50 and communicates with the slotted openings 58 by means of individual passages 112 passing through the lower wall 114 of the manifold 110 and the upper and lower layers 52 and 54 of the sliding seal 50.

The application of vacuum to each individual stage is regulated by a series of valves, generally designated as 130, installed in the top wall 116 of the manifold 110. Each valve 130 comprises a handle 132 connected to a threaded shaft 134, which in turn is connected to a metering needle 136. Each threaded shaft 134 passes through and engages a threaded opening 117 inside a threaded fitting 137 of larger diameter having internal threads engaging the threaded shaft 134 and external threads engaging to the interior threads of a cylindrical bore 118 which protrudes from the top wall 116 of the manifold 110. Each metering needle 136 may have a diameter somewhat larger than the diameter of the passages 112 in the lower wall 114 of the manifold 110 and, by turning the handle 132, can be adjusted at such height as to completely obstruct, partly obstruct, or leave totally unobstructed the flow of gas or material through each individual passage 112.

Figure 3:
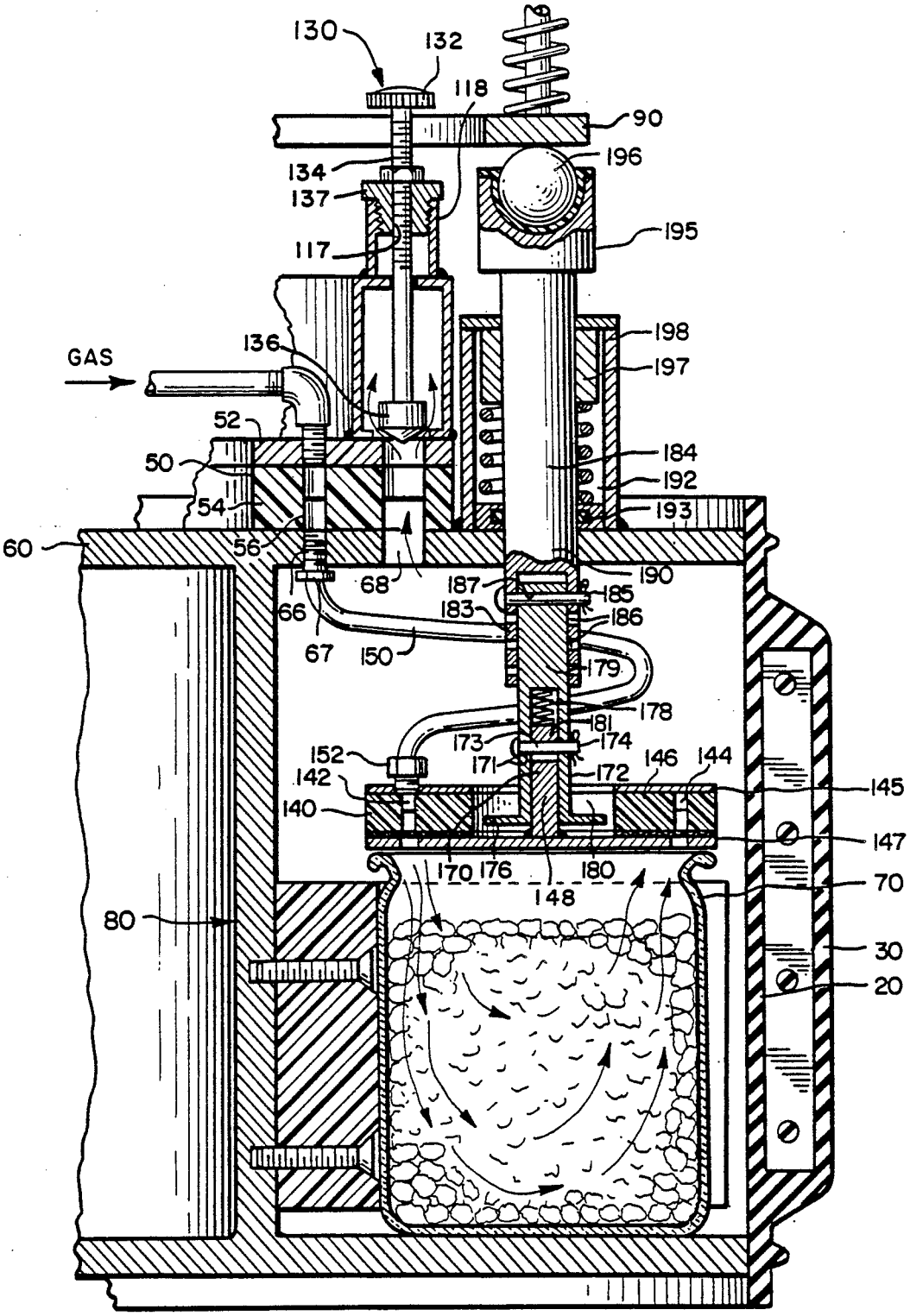
FIG. 3 is a side sectional view of a chamber of the apparatus of FIG. 1, including means above the chamber for applying two sources of environment to the chamber.

The first and second sources of environment can be applied to the interiors of the individual containers 70 by any suitable means including direct communication through a contacting means engaged to the container, indirect communication via chambers in which the containers 70 are placed, or a combination of both. Referring now to FIGS. 1 and 3, a preferred embodiment is illustrated in which a first source of environment comprising a source of gas such as nitrogen and a second source of environment comprising a vacuum source are applied to each container 70 simultaneously by using plungers 140 which are caused to engage to each container 70 as the container 70 passes beneath a cam race 90 via rotation of the rotary drum 10.

The gas is supplied to the container directly through a flexible tube 150 which is engaged to the passage 66 in the top wall 60 of the sealed chamber 80 by means of a fitting 67, and to a vertical passage 142 through the plunger 140 by means of a fitting 152. The vacuum source is applied to the inside of the container 70 indirectly by pulling a vacuum on the entire chamber 80 through the passage 68 in the top wall 60 of the chamber 80 and by transmitting the vacuum from the chamber 80 to the interior of the container 70 through a passage 144 in the plunger 140 which communicates both with the interior of the container 70 and with the interior of the sealed chamber 80.

The flow rates of gas and vacuum are set in the preferred embodiment so that after entering the container through the passage 42, the gas passes through the container in a sweeping fashion according to the arrows shown in FIG. 3 and out through the passage 144 of the plunger 140. For most applications, including the packaging of nuts, the flow rates of gas and vacuum through the container 70 should be such that the overall vacuum pressure inside of the chamber 80 is greater than about 25 inches of mercury.

In addition to the flow rates of gas and vacuum, the circulation of gas within the containers 70 is greatly affected by the configuration, size, and positioning of the inlet and outlet passages 142 and 144 in the plunger 140. The optimum configuration, size, and positioning of the passages 142 and 144 for a specific packaging application will be hereinafter described. Furthermore, both the optimum flow rates and configurations will vary depending on the specific product being purged and the degree of oxygen removal sought to be accomplished.

The plunger 140 includes a top plate 145 which may be constructed of metal, a middle layer 146 which may be constructed of plastic, and a base plate 147 preferably constructed of metal for engagement with the upper rim of the container 70. A piston 190 is attached to the plunger 140, such as by means of a rod-like protrusion 148 projecting upward from the base plate 147 and into a hollow portion 170 in the bottom of the piston 190. The rod-like protrusion 148 is locked into the hollow portion 170 by means of locking pin 174 passing through openings 171 in the wall 172 of the hollow portion 170, and an opening 173 in the rod-like protrusion 148. Preferably, the openings 171 or the openings 173 are in the form of vertical slots in order to allow some lost motion biasing of the hollow portion 170 relative to the plunger 140 by means of spring 178.

Located above the spring 178 is a solid portion 179 telescopically engaging a second hollow portion 182 in a piston rod 184 and connected thereto using a pin 185 passing through openings 186 in the wall 183 of hollow portion 182 and through an opening 187 in the solid portion 179. The plurality of openings 186 allows adjustment of the piston 190 to different lengths by moving the position of the lower solid portion 179 relative to the piston rod 184.

The piston rod 184 passes upward through a sealing means such as an O-ring 193 positioned above the top wall 60 of the chamber 80, and then through a sleeve bearing 197, ultimately engaging a cam follower 195. The cam follower 195 includes a ball bearing 196 which, as shown in FIG. 1, engages a cam race 90 as the rotary drum 10 rotates, causing depression of the entire piston assembly 190 against the force of a spring 192. Plunger 140 thus is brought into contact with the top of the container 70 or, if desired, within proximity of the top of the container 70. A housing 198 may be provided to surround the upper portion of the piston rod 184, the sleeve bearing 197, the O-ring 193, and the spring 192.

It is understood that alternate means may similarly be used for attaching the plunger 140. Further, while it is desirable to provide for vertical movement of the plunger, such movement is not necessary. The plunger may be fixed, or may be eliminated altogether when alternate means for connecting the interior of the container to the environments is employed. Other electrical, hydraulic or pneumatic means may be used for moving the plunger in lieu of the mechanical cam system illustrated.

Figure 8:
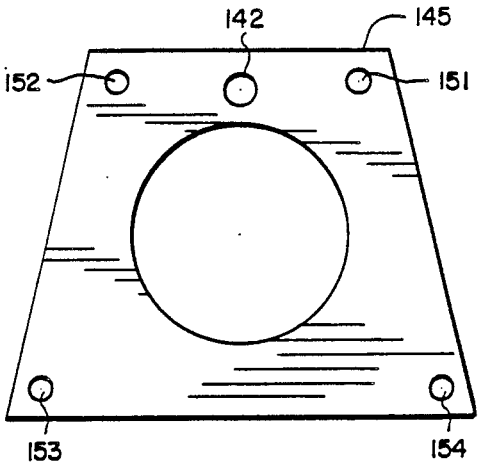
FIG. 8 shows a top view of the top plate of one embodiment of a contacting means.
Figure 9:
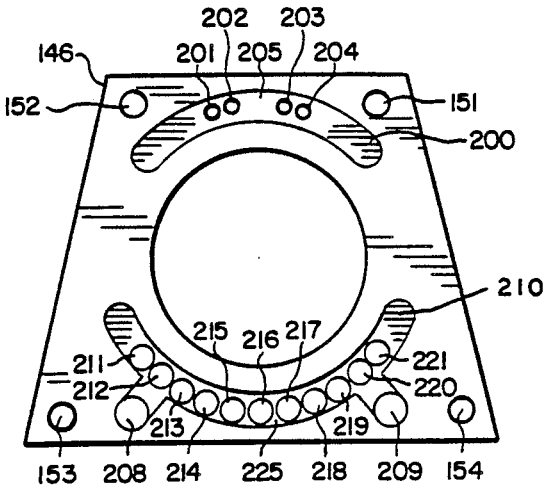
FIG. 9 shows a top view of the middle layer of the embodiment shown in FIG. 8.
Figure 10:
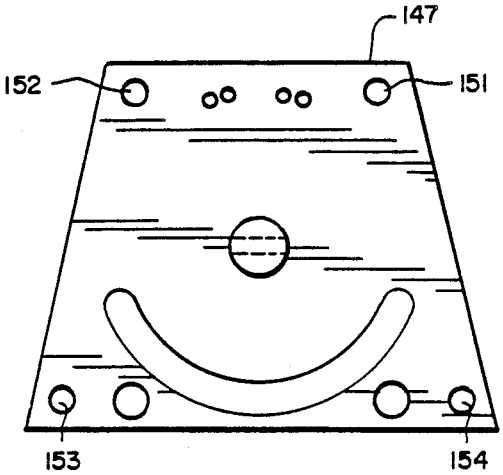
FIG. 10 shows a top view of the lower plate of the embodiment shown in FIG. 8.

Referring now to FIGS. 8, 9, and 10, the optimum design for the plunger 140 is illustrated for a system in which a combination of nitrogen and vacuum are utilized to remove oxygen from a cylindrical container having about a four-inch diameter opening in the top end and replace it with a substantially inert environment comprising nitrogen. This design is for a container containing loose food such as nuts, positioned inside a chamber having a volume of about 0.20 cubic foot, wherein the desired residual oxygen content in the container is less than about 1.0% by volume of the total gas present in the container.

The top plate 145, the middle layer 146, and the base plate 147 of the plunger 140 are held together in a sealing fashion by means of nut and bolt assemblies positioned at four corner openings 151, 152, 153, and 154 of each plunger plate. Each plate is trapezoidal in shape corresponding in general to the cross-sectional shape of the individual chambers to prevent rotation of the plunger 140. The top plate 145 and the bottom plate 147 are preferably constructed of metal and have thicknesses of about 0.187 inches, while the middle layer is preferably constructed of plastic and has a thickness of about 0.720 inches. Other suitable materials may, of course, be utilized.

Nitrogen enters the plunger 140 through passage 142 in the top plate 145 which opens into a curved channel 200 in the middle layer 146. The channel 200 has a width of about 0.375 inches, a depth of about 0.375 inches and a radius of curvature of about 1.75 inches. After entering the curved channel 200, the nitrogen passes into the container 70 through four openings 201, 202, 203, and 204, each having a diameter of about 0.156 inches and passing through the floor of the curved channel 200 and through the bottom plate 147 of the plunger 140. Openings 202 and 203 are located about 10 degrees to the left and right of the centerline 205 of the channel, while openings 201 and 204 are located about 17 degrees therefrom.

The vacuum source is applied to the chamber 80 through passage 68 (FIG. 3). The vacuum in the chamber 80 is in turn applied to the interior of the container 70 through a pair of openings 208 and 209 which are located outside of the area occupied by the contacted container and are therefore exposed to the environment established in the area of the chamber surrounding the container. In the preferred embodiment, these openings 208, 209 are located in the bottom of the plunger 140 and open into a curved channel 210 in the middle layer 146 of the plunger 140. The openings 208 and 209 each have diameters of about 0.375 inches. The curved channel 210 has a width of about 0.375 inches, a depth of about 0.375 inches, and a radius of curvature of about 1.75 inches. From the curved channel 210, the vacuum is applied to the interior of the container 70 through eleven openings labelled 211 thru 221, each having a diameter of about 0.25 inches and located to the left and right of the centerline 225 of the channel 210 in a symmetrical fashion and about 10 degrees from one another.

In a particularly preferred six-stage embodiment, the first two stages involve application of vacuum only to the chamber 80, which in turn communicates with the container 70 through the openings 208 and 209 leading to the passages 211 thru 221 in the plunger 140. The next two stages involve the simultaneous application of both nitrogen and vacuum to the container 70. The final two stages involve the application of nitrogen only in order to bring the inert environment inside the container 70 and chamber 80 to substantially atmospheric pressure.

The optimum flow rates for this application are less than about 12 cubic feet per minute of nitrogen for each stage which utilizes nitrogen, and less than about 10 cubic feet per minute of vacuum for each stage which utilizes vacuum. For the stages which utilize both, the flow rates of nitrogen and vacuum should each be approximately 2 cubic feet per minute such that the overall vacuum pressure inside the chamber 80 is at least about 25 inches of mercury. The optimum flow rate may vary to an extent depending upon the product for which oxygen removal is sought. The number of stages will also vary, but should be at least two, and preferably at least three, for most food products. As the desired line speeds increase, the number of required stages may also increase.

The plunger 140 may further comprise a screen positioned below the middle layer 146 in order to keep product from the container from entering the plunger 140 and clogging the passages. It is further understood that alternative embodiments may comprise different numbers and configurations of passages in the plunger 140 than those described herein. Additional openings may be provided for additional sources of environment as well. The environments may also be applied to the containers in different locations (for example, at the centers).

The openings for the various environments may be dimensioned to create different desired flow patterns. For example, the openings may be enlarged for gentler gas flow or reduced in size to create higher velocity jets. Orifices and nozzles may be employed as well. Further, the environment openings may be inclined radially or circumferentially to create desired flow patterns in the container (for example, swirling or directing the flow against the container walls).

Preferably, the nitrogen will continue to be supplied to the container 70 after the six-stage oxygen removal process has been completed in order to maintain the inert environment until the container 70 is removed from the chamber 80 and transported to the lidding mechanism. Referring to FIG. 2, cam race 90 may for example be extended to the point where the container 70 is removed using the removal means 91.

It should be understood that the present invention may be embodied in other specified forms without departing from its spirit or essential characteristics. The present embodiments are, therefore, to be considered in all respects as illustrative and not restrictive. All changes which come within the meaning and range of the equivalents of the claims are, therefore, intended to be embraced therein.

We claim:

1. An apparatus for sequentially exposing objects to a controlled environment, comprising:

a rotary drum having a chamber therein for receiving said object, said chamber opening into the periphery of said rotary drum;

a substantially continuous flexible belt enclosure;

means for supporting said substantially continuous flexible belt enclosure proximate said opening in the periphery of said rotary drum, such that said substantially continuous flexible belt enclosure contacts a portion of the periphery of said rotary drum and periodically covers said opening in the periphery of said rotary drum; and means communicating with said chamber for supplying said controlled environment thereto while said substantially continuous flexible belt enclosure covers said chamber opening in the periphery of said rotary drum, said means including one or more individual sources of environment.

2. The apparatus of claim 1 wherein said means for supplying said controlled environment includes a plurality of individual sources of environment.

3. The apparatus of claim 2 wherein at least two of said sources of environment are applied simultaneously to the chamber for at least some period of time.

4. The apparatus of claim 3 wherein said means for supplying said controlled environment comprises a plurality of ports communicating with said chamber for supplying said sources of environment to the chamber.

5. The apparatus of claim 4 wherein a first of said plurality of ports communicates with a first source of environment to supply said first source of environment to said chamber, and wherein a second of said plurality of ports communicates with a second source of environment to supply said second source of environment to said chamber.

6. The apparatus of claim 1 wherein said one or more sources of environment comprises a vacuum.

7. The apparatus of claim 1 wherein said one or more sources of environment comprises nitrogen.

8. The apparatus of claim 3 wherein a first of said at least two sources of environment comprises a nitrogen source, and wherein a second of said at least two sources of environment comprises a vacuum source.

9. The apparatus of claim 8 wherein said means for communicating with said chamber includes means for simultaneously supplying nitrogen and vacuum for at least some period of time at such rates as to maintain a net vacuum pressure within the chamber of at least about 25 inches of mercury.

10. An apparatus for sequentially exposing objects to a controlled environment comprising:

a rotary drum having at least one chamber therein for receiving said object, said chamber opening into the periphery of said rotary drum;

a substantially continuous flexible belt enclosure comprising a belt having a plurality of cleats on a back side of said belt;

means for supporting said substantially continuous flexible belt enclosure proximate said opening in the periphery of said rotary drum, such that said substantially continuous flexible belt enclosure contacts a portion of the periphery of said rotary drum and periodically covers said opening in the periphery of said rotary drum; and means communicating with said chamber for supplying said controlled environment thereto while said substantially continuous flexible belt enclosure covers said chamber opening in the periphery of said rotary drum, said means including one or more individual sources of environment.

11. The apparatus of claim 10 wherein said cleats comprise polyurethane.

12. The apparatus of claim 11 wherein said cleats further comprise steel inserts.

13. An apparatus for exposing a container to a controlled environment, comprising:

means for connecting said apparatus to two or more individual sources of environment;

means for selectively connecting a first of said individual sources of environment to the interior of said container; and means for selectively connecting a second of said individual sources of environment to the interior of said container;

said means for connecting said first source of environment to the interior of said container comprising a plunger and means for bringing said plunger into contact with an opening in said container, said plunger having a first set of one or more openings in communication with said opening in said container for applying said first source of environment to said interior of said container, said plunger having a second set of one or more openings in communication with said opening in said container for applying said second source of environment to said interior of said container;

a sealed chamber in which said container can be positioned;

a third set of one or more openings in communication with said interior of said sealed chamber, and one or more conduits in said plunger joining said first set of one or more openings with said third set of one or more openings for applying said first source of environment to said interior of said container.

14. The apparatus of claim 13 wherein said third set of one or more openings is located in a bottom surface of said plunger.

15. The apparatus of claim 14 wherein said first source of environment comprises a vacuum source and said second source of environment comprises a source of inert gas.

16. The apparatus of claim 14 wherein said plunger comprises:

a bottom engagement plate for engaging said container through which said first set of openings, said second set of openings and said third set of openings are formed; and a layer above said bottom engagement plate through which said one or more conduits are formed.

17. An apparatus for sequentially exposing containers to a controlled environment comprising:

a rotary drum;

said rotary drum including a plurality of chambers, said chambers opening into the periphery of said rotary drum;

a moving substantially continuous flexible belt loop;

means for supporting said moving substantially continuous flexible belt loop in contact with a portion of the periphery of said rotary drum, such that said moving substantially continuous flexible belt loop sequentially covers one or more of said chamber openings in the periphery of said rotary drum;

a first flow means adapted to communicate with a container inside said chamber for applying a vacuum thereto while said moving substantially continuous flexible belt loop is covering said chamber openings in the periphery of said rotary drum; and a second flow means adapted to communicate with said container for supplying an inert gas thereto while said moving substantially continuous flexible belt loop is covering said chamber openings in the periphery of said rotary drum;

such that said first flow means and said second flow means are applied simultaneously to said container for at least some period of time.

18. The apparatus of claim 17 further comprising means for sealing said container.

19. The apparatus of claim 17 wherein said first flow means is adapted to communicate with an opening in said container at a position adjacent to a first side of said container, and wherein said second flow means communicates with said opening in said container at a position adjacent to a side of said container opposite said first side.

* * * * *